US009671723B2

(12) United States Patent
Ueno

(10) Patent No.: US 9,671,723 B2
(45) Date of Patent: Jun. 6, 2017

(54) IMAGE FORMING APPARATUS WITH CLEANING BLADE AND RUBBING ROTATABLE MEMBER

(71) Applicant: CANON KABUSHIKI KAISHA, Tokyo (JP)

(72) Inventor: Takashi Ueno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/098,487

(22) Filed: Apr. 14, 2016

(65) Prior Publication Data

US 2016/0306303 A1 Oct. 20, 2016

(30) Foreign Application Priority Data

Apr. 17, 2015 (JP) ..... 2015-085442

(51) Int. Cl.
*G03G 15/16* (2006.01)
*G03G 15/23* (2006.01)

(52) U.S. Cl.
CPC ..... *G03G 15/161* (2013.01); *G03G 15/1615* (2013.01); *G03G 15/234* (2013.01); *G03G 2215/1661* (2013.01)

(58) Field of Classification Search
CPC ..... G03G 15/161; G03G 15/0189; G03G 15/6579; G03G 21/0076; G03G 2215/00421; G03G 2215/0043; G03G 2215/00438; G03G 2215/1661; G03G 2215/0122; G03G 2215/0125; G03G 2215/0196; G03G 2221/001; G03G 15/1615; G03G 15/234
USPC ..... 399/66, 71, 101, 302, 308, 401, 44
See application file for complete search history.

(56) References Cited

U.S. PATENT DOCUMENTS

| | | | |
|---|---|---|---|
| 7,343,133 | B2 | 3/2008 | Ueno |
| 7,620,357 | B2 | 11/2009 | Shakuto et al. |
| 7,764,917 | B2 | 7/2010 | Ueno |
| 8,953,973 | B2 | 2/2015 | Aiba et al. |
| 9,075,371 | B2 | 7/2015 | Ueno |

(Continued)

FOREIGN PATENT DOCUMENTS

| | | | |
|---|---|---|---|
| JP | 10010939 A | * | 1/1998 |
| JP | 2003-215938 A | | 7/2003 |

(Continued)

*Primary Examiner* — Robert Beatty
(74) *Attorney, Agent, or Firm* — Fitzpatrick, Cella, Harper & Scinto

(57) ABSTRACT

An image forming apparatus includes an image bearing member; an intermediary transfer belt rotatable in a predetermined direction, a rubbing rotatable member provided between the secondary transfer portion and a cleaning blade with respect to the predetermined direction and configured to rub the belt; and a controller for controlling the belt such that after start of a both-side-printing mode operation in which the toner images are formed on respective sides of the recording material, the rotation of the belt is stopped at an end or interruption of the both-side-printing mode operation, and the belt is rotated in a direction opposite from the predetermined direction at least until a portion of the belt contacting the cleaning blade at the time of the stop of the rotation of the belt reaches a position opposing the rubbing rotatable member.

5 Claims, 7 Drawing Sheets

(56) References Cited

U.S. PATENT DOCUMENTS

| | | | | |
|---|---|---|---|---|
| 2004/0234281 | A1* | 11/2004 | Yoshida | G03G 15/55 399/24 |
| 2007/0286636 | A1* | 12/2007 | Inada | G03G 21/0011 399/101 |
| 2008/0247772 | A1* | 10/2008 | Ishida | G03G 15/161 399/66 |
| 2015/0055970 | A1* | 2/2015 | Mori | G03G 21/0011 399/71 |

FOREIGN PATENT DOCUMENTS

| | | | | |
|---|---|---|---|---|
| JP | 2003241530 | A | * | 8/2003 |
| JP | 2005338709 | A | * | 12/2005 |
| JP | 2007-004065 | A | | 1/2007 |
| JP | 2009103987 | A | * | 5/2009 |
| JP | 2009230049 | A | * | 10/2009 |
| JP | 2013057799 | A | * | 3/2013 |
| JP | 2014-009062 | A | | 1/2014 |

* cited by examiner

IMAGE FORMING APPARATUS WITH CLEANING BLADE AND RUBBING ROTATABLE MEMBER

FIELD OF THE INVENTION AND RELATED ART

The present invention relates to an image forming apparatus which forms an image on a recording medium with the use of an electrophotographic method or the like.

There has been known in the field of image formation, an image forming apparatus of the so-called intermediary transfer type, which forms a toner image on its photosensitive drum, transfers (primary transfer) onto its intermediary transfer belt, and then, transfers (secondary transfer) the toner image onto a recording medium from the intermediary transfer belt. In the case of an image forming apparatus of the intermediary transfer type, it occurs sometimes that a certain amount of toner (which hereafter may be referred to as transfer residual toner) remains on the intermediary transfer belt, after the secondary transfer, and/or, that external additives, or the like, contained in toner, adhere to the intermediary transfer belt.

Thus, an image forming apparatus of the intermediary transfer type is provided with a belt cleaning device for removing the transfer residual toner and/or the external additives remaining adhered to the intermediary transfer belt. There is proposed in Japanese Laid-open Patent Application No. 2003-215938, a belt cleaning device which has: a cleaning blade which mechanically scrapes down the transfer residual toner and external additives from the intermediary transfer belt by being placed in contact with the intermediary transfer belt; and a brush roller which electrostatically adheres the transfer residual toner to itself by rubbing the intermediary transfer belt.

In recent years, in order to ensure that toner becomes fixed to a recording medium even when the ambient temperature is low, it has become a common practice to use toner that contains such wax that melts at a relatively low temperature. In order to fix a toner image to a sheet of recording medium, heat is applied to the sheet and the toner image thereon. Thus, immediately after an image was formed on the first surface of a sheet of recording medium, the sheet has a substantial amount of heat, because it was heated to fix the toner image. Thus, it is possible that melted wax will ooze out of the sheet. Therefore, if the sheet P from which melted wax is oozing out is immediately turned over, and an image is formed on the second surface of the sheet, immediately after the formation of an image on the first surface, the wax transfers from the sheet to the secondary transfer outside roller, and adheres to the roller. Then, the wax is transferred from the secondary transfer outside roller to the intermediary transfer belt, and adheres to the intermediary transfer belt. The wax having adhered to the intermediary transfer belt is scraped away from the intermediary transfer belt by a cleaning blade.

However, as the wax is scraped away from the intermediary transfer belt, it tends to collect and agglomerate between the cleaning edge of the cleaning blade and the intermediary transfer belt. Therefore, it is possible that a substantial number of relatively large lumps of wax will form on the intermediary transfer belt. As these lumps of wax cool down, they harden, and become fixed to the intermediary transfer belt. Once the lumps of wax become fixed to the intermediary transfer belt, it becomes harder for them to be removed by the cleaning blade than when they are soft. Moreover, as the solid lumps of wax form on the intermediary transfer belt, toner and external additives collect around the lumps of wax during an image forming operation, causing thereby image defects, and/or, causing the cleaning blade to buckle, and/or, parts of cleaning edge of cleaning blade to break away.

SUMMARY OF THE INVENTION

According to an aspect of the present invention, there is provided an image forming apparatus comprising an image bearing member on which a toner image is formed; an intermediary transfer member contacting said image bearing member to form a primary transfer portion between itself and said image bearing member, wherein said intermediary transfer member is rotatable in a predetermined direction, and the toner image is primary-transferred onto said intermediary transfer member in the primary transfer portion, during a image forming operation; a secondary-transfer rotatable member contacting said intermediary transfer member to form a secondary transfer portion between itself and said intermediary transfer member, when the toner image is secondary-transferred, from said intermediary transfer member onto a recording material in the secondary transfer portion; a fixing device configured to heat the toner image on the recording material to fix the toner image on the recording material; a feeding portion configured to reverse a facing orientation of the recording material having passed through said fixing device and to feed the recording material into the secondary transfer portion; a cleaning blade contacting said intermediary transfer member at the position downstream of said secondary transfer portion with respect to the predetermined direction; a rubbing rotatable member provided between said secondary transfer portion and said cleaning blade with respect to the predetermined direction and configured to rub said intermediary transfer member; a driving source configured to rotate said intermediary transfer member; and a controller configured to control said intermediary transfer member such that after start of a double-sided printing mode operation in which the toner images are formed on respective sides of the recording material, the rotation of said intermediary transfer member is stopped at an end or interruption of the double-sided printing mode operation, and said intermediary transfer member is rotated in a direction opposite from the predetermined direction at least until a portion of said intermediary transfer member contacting said cleaning blade at the time of the stop of the rotation of said intermediary transfer member reaches a position opposing said rubbing rotatable member.

Further features of the present invention will become apparent from the following description of exemplary embodiments (with reference to the attached drawings).

DESCRIPTION OF THE EMBODIMENTS

<Embodiment 1>

Figure 1:
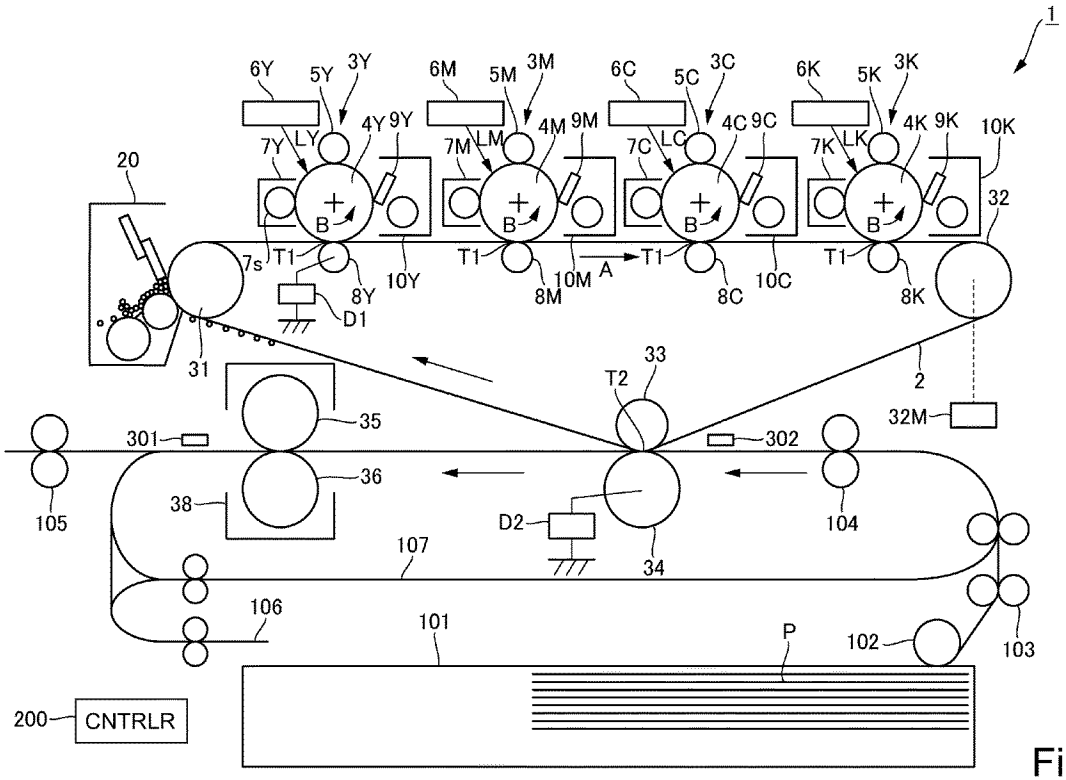
FIG. 1 is a drawing for showing the general structure of the image forming apparatus in the first embodiment of the present invention.

Referring to FIGS. 1-7, the first embodiment of the present invention is described. To begin with, referring to FIG. 1, the image forming apparatus in this embodiment is described.

<Image Forming Apparatus>

An image forming apparatus 1 is a full-color printer of the so-called tandem type, and also, of the so-called intermediary transfer type. It has an intermediary transfer belt 2, and four image forming sections, more specifically, yellow, magenta, cyan, and black image forming sections 3Y, 3M, 3C and 3K, respectively, which are aligned along the intermediary transfer belt 2.

In the image forming section 3Y, a yellow toner image is formed on its photosensitive drum 4Y, and is transferred (primary transfer) onto the intermediary transfer belt 2. In the image forming section 3M, a magenta toner image is formed on the photosensitive drum 4M, and is transferred onto the intermediary transfer belt 2 so that it is layered upon the yellow toner image on the intermediary transfer belt 2. In the image forming sections 3C and 3K, cyan and black toner images are formed on their photosensitive drums 4C and 4K, respectively, and are sequentially transferred onto the intermediary transfer belt 2 so that they are layered up the yellow and magenta toner images on the intermediary transfer belt 2.

The image forming sections 3Y, 3M, 3C and 3K are roughly the same in structure, although they are different in the color (yellow, magenta, cyan and black, respectively) of the toner they use. Hereafter, therefore, only the image forming section 3Y is described in detail. The description of the image forming sections 3M, 3C and 3K are the same as that of the image forming section 3Y, except for the suffixes M, C and K.

The image forming section 3Y has the photosensitive drum 4Y. It has also a charge roller 5Y, an exposing device 6Y, a developing device 7Y, a primary transfer roller 8Y, and a drum cleaning device 10Y, which are disposed in the adjacencies of the peripheral surface of the photosensitive drum 4Y in a manner to surround the photosensitive drum 4Y. The photosensitive drum 4Y, which is an image bearing component, is an electrophotographic photosensitive component. It is in the form of a drum, and is rotatably supported. It is rotated by an unshown photosensitive drum driving motor at a preset process speed in the counterclockwise direction (indicated by arrow mark B in FIG. 1). The photosensitive drum 4Y is made up of an aluminum cylinder, and a photosensitive layer formed on the peripheral surface of the photosensitive drum 4Y, as will be described later (with reference to FIG. 2).

The charge roller 5Y uniformly charges the peripheral surface of the photosensitive drum 4Y. More specifically, as oscillatory voltage, which is a combination of negative DC voltage and AC voltage is applied to the charge roller 5Y, the charge roller 5Y uniformly and negatively charges the peripheral surface of the photosensitive drum 4Y to a preset potential level (pre-exposure level). The exposing device 6Y writes an electrostatic latent image on the uniformly charged peripheral surface of the photosensitive drum 4Y, by scanning, with the use of a rotational mirror, the peripheral surface of the photosensitive drum 4Y with a beam of laser light which it emits while modulating (turning on or off) with the image formation data obtained by separating an original (image to be formed), into multiple monochromatic images of primary color. The exposing device 6Y may be an analog exposing device which projects an image of an original onto an image bearing component, or a digital exposing device such as a laser scanner, an LED array, etc.

The developing device 7Y develops the electrostatic latent image into a toner image by supplying toner to the photosensitive drum 4Y. It has a development sleeve 7S, which is disposed so that there is a minute amount of gap between the peripheral surface of the development sleeve 7S and photosensitive drum 4Y. The development sleeve 7S is rotated in the opposite direction from the photosensitive drum 4Y. The developing device 7Y charges two-component developer, which is a mixture of toner and carrier. It causes the development sleeve 7S to bear the charged two-component toner, and conveys the developer to where the peripheral surface of the development sleeve 7S opposes the peripheral surface of the photosensitive drum 4Y. As oscillatory voltage, which is a combination of DC voltage and AC voltage, is applied to the development sleeve 7S, negatively charged nonmagnetic toner transfers onto the exposed points of the peripheral surface of the photosensitive drum 4Y, which were made positive relative to the negative charged toner by the exposure. Consequently, the electrostatic latent image is developed in reverse. By the way, FIG. 1 shows the development sleeve 7S only in developing device 7Y. It is needless to say, however, that the development sleeves 7M, 7C and 7K also are provided with the development sleeve 7S.

The primary transfer roller 8Y forms the primary transferring section T1 (primary transfer nip) between the photosensitive drum 4Y and intermediary transfer belt 2 by pressing on the intermediary transfer belt 2. The primary transfer roller 8Y is in connection to the primary transfer voltage (high voltage) power source D1, from which the primary transfer voltage (bias), which is positive in polarity, is applied to the primary transfer roller 8Y, whereby the negatively charged toner image on the photosensitive drum 4Y is transferred onto the intermediary transfer belt 2.

The drum cleaning device 10Y recovers the toner remaining on the photosensitive drum 4Y on the downstream side of the primary transferring section T1 in terms of the moving direction of the intermediary transfer belt 2. The drum cleaning device 10Y is provided with a cleaning blade 9Y, which is formed of polyurethane. The cleaning blade 9Y is 2 mm in thickness, and 70 in hardness scale A (measured with use of durometer). The cleaning blade 9Y is placed in contact with the peripheral surface of the photosensitive drum 4Y.

The intermediary transfer belt 2 is an intermediary transferring component. It is rotatable in contact with the photosensitive drum 4Y. It is suspended by a combination of a tension roller 31, a driver roller 32, and a belt-backing roller 33 (secondary transfer roller disposed within loop which intermediary transfer belt 2 forms), in such a manner that the intermediary transfer belt 2 bridges between the adjacent two belt suspending rollers. The intermediary transfer belt 2 circularly moves by being driven by the driver roller 32. The tension roller 31 provides the intermediary transfer belt 2 with a preset amount of tension. The driver roller 32 is driven by an intermediary transfer belt driving motor 32M as a driving means. The image forming apparatus 1 is structured so that the driver roller 32 and intermediary transfer belt 2 can be rotationally driven in the positive or reverse direction by the driving motor 32. More specifically, in this embodiment, during a period in which an image is actually formed, the intermediary transfer belt 2 is driven so that, in the area of contact between itself and the peripheral surface of the photosensitive drum 4Y, it moves in the same direction (indicated by arrow mark A in FIG. 1, and referred to as positive direction for convenience sake), as the moving direction (indicated by arrow mark B in FIG. 1) of the peripheral surface of the photosensitive drum 4Y, whereas during a wax removal period (which will be described later with reference to FIG. 6, for example), the intermediary transfer belt 2 is rotated in the opposite direction from the positive direction (indicated by arrow mark A).

By the way, an "image forming period" is a period in which a toner image is actually formed on the photosensitive drum 4Y, based on the image data inputted from the scanner with which the image forming apparatus 1 is provided, image data inputted from an external device such as a personal computer, or the like data. An "idling period" is a period, such as recording sheet intervals, in which no image is formed.

The intermediary transfer belt 2 is an endless belt. It is a single-layer belt formed of resinous substance, such as co-polymer of polyethylene and tetrafluoroethylene, which contains fluorine. The intermediary transfer belt 2 is adjusted in electrical resistance to $1\times10^{12}$ [Ω/□] in surface resistivity, and $1\times10^{9}$ [Ω·cm] in volume resistivity, by the dispersion of carbon black particles in its base material.

The four toner images, different in color, transferred onto the intermediary transfer belt 2 (intermediary transferring component) are conveyed to the secondary transferring section T2 (secondary transfer nip), and transferred together (secondary transfer) onto a sheet P of recording medium (recording paper, OHP film, and the like). The sheets P of recording medium in a recording medium cassette 101 are moved out of the cassette 101 one by one by a pickup roller 102 while being separated from the rest. A pair of registration rollers 104 send each sheet P of recording medium to the secondary transferring section T2 with such a timing that the sheet P arrives at the secondary transferring section T2 at the same time as the four toner images, different in color, on the intermediary transfer belt 2. After the secondary transfer of the four toner images, different in color, onto the sheet P, the sheet P is sent to the fixing device 38, in which it is subjected to heat and pressure applied by a combination of a heat roller 35 and a pressure roller 36. Thus, the toner images on the sheet P are heated, and become fixed to the sheet P.

After the fixation of the toner images to the sheet P of recording medium, the sheet P is conveyed further. However, where the sheet P is conveyed after the fixation of the toner images in the one-sided printing mode, in which an image is formed on only one of the two surfaces of the sheet P, is different from where the sheet P is conveyed after the fixation of the toner images in the two-sided printing mode, in which an image is formed on both surfaces of the sheet P. In the one-sided printing mode, the sheet P is discharged out of the apparatus main assembly through a pair of discharge rollers 105 immediately after being conveyed through the fixing device 38.

On the other hand, in the two-sided printing mode, after the fixation of the toner images to the sheet P of recording medium, the sheet is conveyed to the secondary transferring section T2 for the second time. That is, the sheet P is conveyed through a combination of a reversal conveyance passage 106 and a two-sided printing conveyance passage 107, to be turned over so that an image can be formed on the second surface of the sheet P, which is the opposite surface (second surface) from the surface (first surface) on which an image has just been formed. Then, it is conveyed to the secondary transferring section T2 for the second time. More concretely, after the sheet P is conveyed through the fixing device 38, it is sent into the reversal conveyance passage 106, and then, is changed in the direction in which it is moved, so that the edge of the sheet P which was trailing when the sheet P was moved into the reversal conveyance passage 106 becomes the leading edge when the sheet P is conveyed through the two-sided printing conveyance passage 107. The two-sided printing conveyance passage 107 sends the sheet P to the pair of registration rollers 104 so that the sheet P is conveyed to the secondary transferring section T2 for the second time. Then, an image is transferred (secondary transfer) onto the second surface (back surface) of the sheet P, and is fixed to the sheet P. Then, the sheet P is discharged from the apparatus main assembly by the pair of discharge rollers 105.

The secondary transferring section T2 is formed by the pressing of the secondary transfer outside roller 34 (relative to belt loop) against the secondary transfer inside roller 33 (with reference to belt loop), with the presence of the intermediary transfer belt 2 between the two secondary transfer rollers 34 and 33. The secondary transfer outside roller 34 is such a roller that comprises a metallic shaft, and an elastic layer formed on the peripheral surface of the metallic shaft, of ion-conductive foamed rubber (NBR). The secondary transfer outside roller 34 which is a rotational secondary transferring component is in connection to the secondary transfer high voltage power source D2, which is variable in bias voltage. The secondary transfer inside roller 33 is grounded. Thus, as positive voltage (secondary transfer bias), which is opposite in polarity from toner, is applied to the secondary transfer outside roller 34 by the secondary transfer high voltage power source D2, an electric field (transfer electric field) is generated in the secondary transferring section T2. In response to this transfer electric field, the four toner images, different in color, that is, the yellow, magenta, cyan, and black toner images, which are negatively charged and have just been transferred onto the intermediary transfer belt 2, are transferred together (secondary transfer) onto a sheet P of recording medium as the sheet P is conveyed through the secondary transferring section T2. The transfer residual toner, that is, the toner remaining adhered to the intermediary transfer belt 2 after the secondary transfer, is recovered from the intermediary transfer belt 2 by the belt cleaning device 20, which will be described later with reference to FIG. 3.

<Two-Component Developer>

The developing device 7Y uses two-component developer which contains negatively chargeable toner (nonmagnetic) and positively chargeable carrier, for example. In this embodiment, such two-component developer that is 9:91 in weight ratio between the toner and carrier, in other words, such two-component developer that is 9% in toner density, is used. Further, the toner is 5.7 μm in weigh average particle diameter.

The toner is made up of bonding resin (which is sometimes referred to as binder), coloring agent, and charge controlling agent. As the bonding resin, styrene-acrylic resin, for example, is used. Needless to say, the selection of the bonding resin is not limited to styrene-acrylic resin. For example, styrene, polyester, polyethylene, or the like, may be used. As the coloring agent, carbon black, dye, pigment, etc., may be used alone or in combination. The charge controlling agent may be added as necessary. All that is necessary is that toner contains nigrosine dye, triphenylmethane dye, or the like, as the charge controlling agent.

Further, the toner contains wax, which is for improving the toner in terms of toner image fixation to a sheet P of recording medium, and toner image separation from the fixing device 38. As for the wax choice, paraffin wax, carnauba wax, polyolefin wax, or the like, is used. The wax is dispersed in the bonding resin. In this embodiment, such toner that is made by kneading a mixture of bonding resin, coloring agent, charge controlling agent, and wax, and then, pulverizing the hardened mixture with the use of a mechanical pulverizing machine, is used.

Further, the toner contains external additives. As the external additives, amorphous silica which was made hydrophobic, microscopic particles of inorganic oxide such as titanium oxide and the like titanium compound, etc., may be used. These microscopic particles are added to toner to adjust the toner in fluidity and amount of charge. The external additives are desired to be no less than 1 nm and no more than 100 nm in diameter. In this embodiment, titanium oxide particles which are 50 nm in average particle diameter, amorphous silica particles which are 2 nm in average particle diameter, and amorphous silica particles which are 100 nm in average particle diameter, are added as external additives by 0.5 wt. %, 0.5 wt. %, and 1.0 wt. %, respectively.

As the carrier, iron particles which were superficially oxidized or not, metallic substances such as nickel, cobalt, manganese, chrome, rare-earth metal, their alloys, ferrite oxide, or the like, can be used with desirable effects. In this embodiment, ferrite particles which were superficially coated with silicon resin was used. There were, 24 [$Am^2$/kg] in saturation magnetization in a magnetic field which is 240 [kA/m], $1\times10^7$ [Ω·m]-$1\times10^8$ [Ω·m] in resistivity in an electric field which is 3,000 [V/cm] in strength, and 50 μm in weight average particle diameter.

Figure 2:
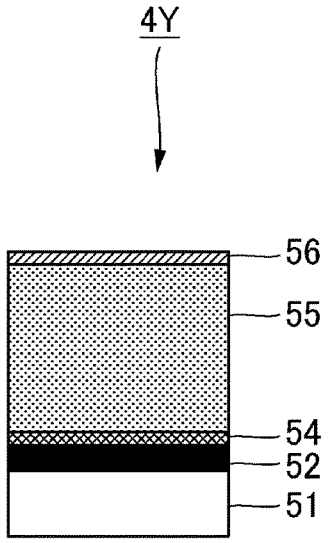
FIG. 2 is a schematic sectional view of a part of the photosensitive drum in the first embodiment, which shows the structure of the photosensitive drum.

Next, referring to FIG. 2, the photosensitive drum 4Y is described about its structure. Referring to FIG. 2, the photosensitive drum 4Y comprises an electrically conductive substrative component 51 (which hereafter may be referred to simply as substrate 51), such as an aluminum cylinder, for example. It comprises also an under coat layer 52, OPC photosensitive layers 54 and 55, and a protective surface layer 56, which were formed in layers in the listed order on the peripheral surface of the substrate 51. The undercoat layer 52 covers the electrically conductive substrate 51 to improve the photosensitive drum 4Y in terms of the adhesion of the OPC photosensitive layers to the substrate 51, and ease with which the OPC photosensitive layers can be coated on the electrically conductive substrate 51. Further, it covers the electrically conductive substrate 51 to protect the electrically conductive substrate 51, and also, cover the blemishes of the peripheral surface of the electrically conductive substrate 51. Further, it covers the electrically conductive substrate 51 to improve the photosensitive drum 4Y in terms of the charge injection from the electrically conductive substrate 51. Moreover, it covers the electrically conductive substrate 51 to protect the OPC photosensitive layer from electrical destruction.

The OPC photosensitive layer has: a charge generation layer 54 which contains a charge generating substance; and a charge transfer layer 55 which contains a charge transferring substance. The charge generation layer 56 is formed on the undercoat layer 52, and the charge transfer layer 55 is formed on the charge generation layer 54. The protective surface layer 55 is formed on the OPC photosensitive layer. By the way, the peripheral surface of the photosensitive drum 4Y, that is, the outward surface of the protective surface layer 56 with reference to the belt loop, has been abraded (buffed) by abrasive tape (lapping paper) so that it became 0.2-2.0 μm in ten point average roughness Rz (JIS B0601-1982).

<Belt cleaning device>

As described above, in order to remove the transfer residual toner and the like which passed through the secondary transferring section T2 and is remaining on the intermediary transfer belt 2, the image forming apparatus 1 is provided with the belt cleaning device 20. Referring to FIG. 1, the belt cleaning device 20 is disposed on the upstream side of the photosensitive drum 4Y in terms of the positive moving direction of the intermediary transfer belt 2. Next, referring to FIGS. 3 and 4, the belt cleaning device 20 is described.

Figure 3:
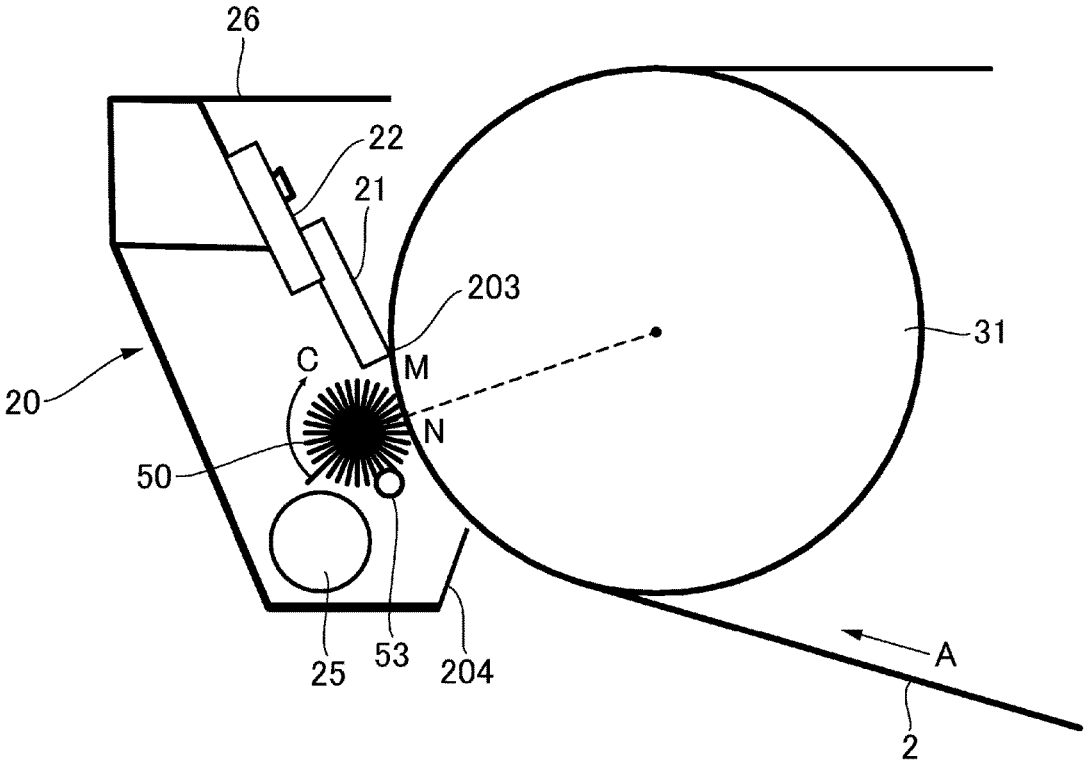
FIG. 3 is a schematic sectional view of the cleaning device, which is for showing the structure of the cleaning device.

The belt cleaning device 20 shown in FIG. 3 is structured so that it employs both the electrostatic cleaning method and blade-based cleaning method. This belt cleaning device 20 is disposed on the opposite side of the intermediary transfer belt 2 from the tension roller 31. It comprises a brush roller 50 (as a rotational brushing component), a cleaning blade 21, and a housing 26 in which the brush roller 50 and cleaning blade 21 are disposed. In terms of the positive rotational direction of the intermediary transfer belt 2, the cleaning blade 21 is in contact with the intermediary transfer belt 2 on the downstream side of the secondary transferring section T2. Also in terms of the positive rotational direction of the intermediary transfer belt 2, the brush roller 50 is disposed between the secondary transferring section T2 and cleaning blade 21. It rubs the intermediary transfer belt 2.

Figure 5:
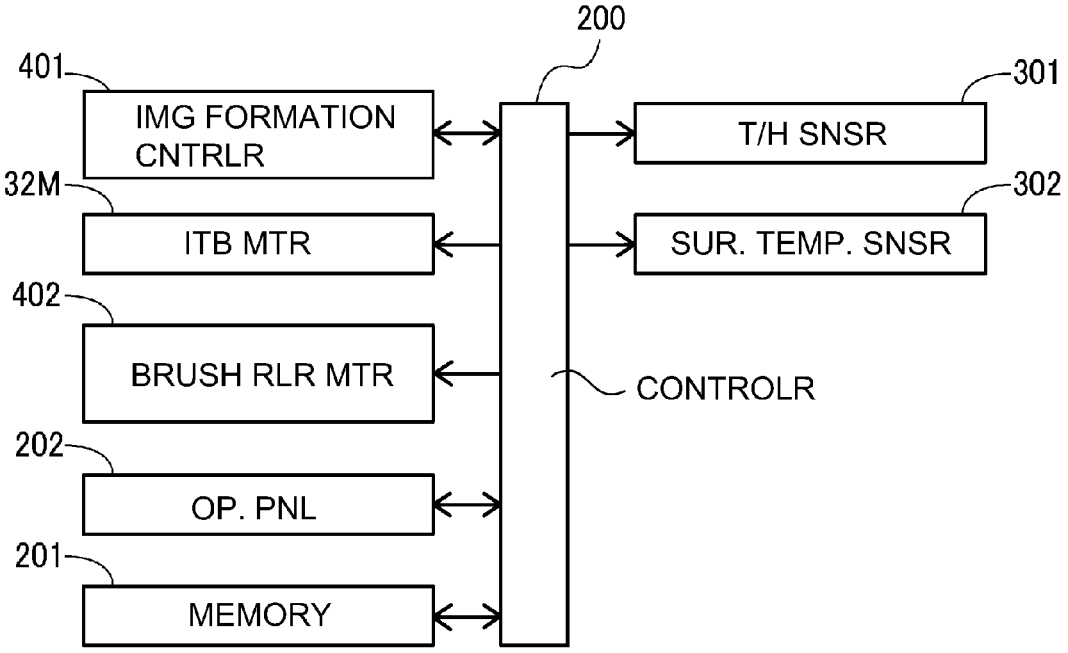
FIG. 5 is a block diagram of the control system of the image forming apparatus, which is related to wax removal.

The brush roller 50 is in contact with the intermediary transfer belt 2 in such a manner that the intermediary transfer belt 2 is sandwiched by the brush roller 50 and tension roller 31. Further, it is disposed so that it theoretically intrudes into the intermediary transfer belt 2 by roughly 1.0 mm. It is rotatable by a brush roller driving motor 403 (FIG. 5). In this embodiment, the brush roller 50 is rotated in such a direction that, in the area of contact between the brush roller 50 and intermediary transfer belt 2, its rotates in the opposite direction (indicated by arrow mark C in FIG. 3) from the positive rotational direction of the intermediary transfer belt 2. By the way, a flicker 53 which is a piece of metallic rod is placed in contact with the brush roller 50 so that it intrudes into the brush roller 50 by roughly 1.0 mm from the outward tip of each bristle of the roller brush 50.

Figure 4:
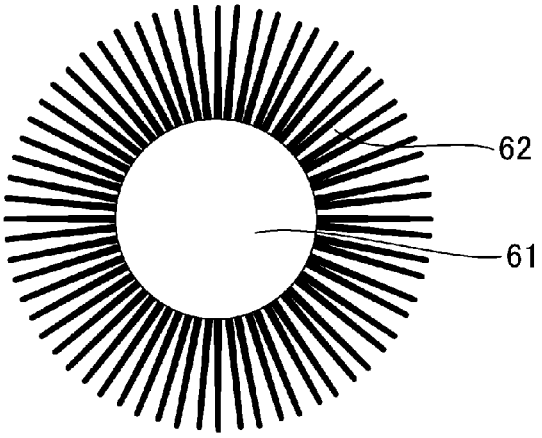
FIG. 4 is a schematic sectional view of the brush roller.

Referring to FIG. 4, the brush roller 50 comprises an electrically conductive metallic core 61, and numerous fine bristles 62 planted on the peripheral surface of the metallic core 61 at a density of 700,000 bristles/$inch^2$. Each bristle 62 is 4 mm in length, and 6 denier in thickness. It is formed of a compound made by dispersing carbon particles in Nylon.

Referring again to FIG. 3, the brush roller 50 removes the transfer residual toner, paper dust, etc., on the intermediary transfer belt 2 by electrostatically adhering the residual toner, paper dust, etc., to itself by being rotated in the opposite direction from the positive rotational direction of the intermediary transfer belt 2, during an image forming operation. As the transfer residual toner adheres to the brush roller 50, it is flicked down, along with paper dust, by the flicker 53. Then, the transfer residual toner and paper dust are conveyed by a conveyance screw 25 for recovered toner, and are discharged into an unshown recovery container.

However, the amount by which the transfer residual toner is adhered to the brush roller 50 is very small, compared to the amount by which the transfer residual toner is removed by the cleaning blade 21. That is, most of the transfer residual toner on the intermediary transfer belt 2 passes by the brush roller 50. This is why it is on the downstream side of the brush roller 50 in terms of the positive rotational direction of the intermediary transfer belt 2 that the cleaning blade 21 is disposed. The cleaning blade 21 is placed in contact with the intermediary transfer belt 2 in such an attitude that its cleaning edge is on the upstream side of its base section in terms of the positive rotational direction (indicated by arrow mark A in drawing) of the intermediary transfer belt 2. It mechanically scrapes the transfer residual toner away from the intermediary transfer belt 2 during an image forming operation. As the transfer residual toner is scraped away from the intermediary transfer belt 2, it is discharged into the unshown recovery container. Further, the cleaning blade 21 scrapes away the wax having adhered to the intermediary transfer belt 2 during an image forming operation. However, the wax is different from the transfer residual toner in that it is sticky. Thus, as the wax is scraped away from the intermediary transfer belt 2, it tends to collect across the cleaning edge of the cleaning blade 21.

The cleaning blade 21 is an elastic blade, more specifically, a piece of rubber plate. It is attached to a metallic base 22 by its base section. The cleaning blade 21, or an elastic blade, is required not to frictionally scar the intermediary transfer belt 2, and to be highly resistant to frictional wear. Therefore, a component formed of polyurethane rubber or the like has been widely used as the cleaning blade 21. Since the cleaning blade 21 is required to be small in the amount of residual deformation, thermally curable polyurethane of two-liquid type may be used as the material for the cleaning blade 21. Further, styrene-butadiene copolymer, chloroprene, butadiene rubber, ethylenepropylenediene rubber, chlorosulfonated polyethylene rubber, fluorinated rubber, or the like may be used. The cleaning blade 21 is 340 mm in length (dimension in terms of direction parallel to rotational axis of tension roller 31), 2 mm in thickness, and 15 mm in width (height) (dimension in terms of direction perpendicular to axial line of tension roller 31). Further, it is 8 mm in the dimension of its flexible section in terms of the direction perpendicular to the axial line of the tension roller 31.

The belt cleaning device 20 is provided with a scatter prevention sheet 204, which is attached to the upstream edge of the housing 26, in terms of the positive rotational direction (indicated by arrow mark A in FIG. 3) of the intermediary transfer belt 2, in a manner to block the gap between the intermediary transfer belt 2 and housing 26. The scatter prevention sheet 204 prevents the problem that as the transfer residual toner, paper dust, and the like are removed from the intermediary transfer belt 2, they leak out of the housing 26. It is formed of a sheet of polyethylene terephthalate resin, for example, which is 20 μm-50 μm in thickness.

<Control Section>

Referring to FIG. 1, the image forming apparatus 1 is provided with a controlling section 200, which is described with reference to FIG. 5 along with FIG. 1. By the way, the controlling section 200 is in connection to the above-described primary transfer high voltage power source D1, secondary transfer high voltage power source D2, etc., in addition to those illustrated in FIGS. 1 and 5, through unshown interfaces. These components, however, are not directly related to the gist of the present invention, and therefore, are neither illustrated nor described.

The controlling section 200 is made up of a CPU or the like. It controls various operations, for example, image forming operation, of the image forming apparatus 1. Referring to FIG. 5, it has a memory 201, such as a ROM and a RAM, in which various programs, data, etc., for controlling the image forming apparatus 1 are stored. Further, the memory 201 is enabled to temporarily store the results of the computations which occur as the programs are carried out. A control panel 202 is a section of the image forming apparatus 1, through which a user can select various image formation programs, input program start signals and various data, or carries out the like operations. In this embodiment, the image forming apparatus 1 is structured so that an operator can set the image forming apparatus 1 in the two-sided printing mode in which an image is formed on both surfaces of a sheet P of recording medium, or the one-sided printing mode in which an image is formed on only one of the two surfaces of the sheet P.

The controlling section 200 carries out one of the image formation programs stored in the memory 201, based on the image data inputted through the control panel 202. Further, the controlling section 200 is enabled to carry out a program for removing the wax having accumulated on the intermediary transfer belt 2 (it is enabled to operate image forming apparatus 1 in wax removal mode, shown in FIG. 6), as will be described later in detail. Based on these programs, the controlling section 200 is capable of controlling each of the following sections of the image forming apparatus 1, to which it is in connection through the unshown interfaces.

The controlling section 200 is in connection to an image formation controlling section 401 which controls each of the four image forming sections 3Y-3K. The image formation controlling section 401 controls each of the image forming sections 3Y-3K in response to the signals (commands) from the control section 200.

The controlling section 200 is also in connection to an intermediary transfer belt (ITB) driving motor 32M which drives the intermediary transfer belt 2. The intermediary transfer belt driving motor 32M is driven in response to the signal (command) from the controlling section 200. More specifically, it can circularly move the intermediary transfer belt 2 in the positive or negative direction, or stop the intermediary transfer belt 2, in response to the signal (command) from the controlling section 200. That is, the intermediary transfer belt 2 can be rotated in the positive or negative direction, or stopped by the controlling section 200.

The controlling section 200 is in connection to a brush roller driving motor 402, as a rotationally driving means, which drives the brush roller 50 of the belt cleaning device 20. The brush roller driving motor 402 is driven in accordance with the signal (command) from the controlling section 200 to rotate or stop rotating the brush roller 50.

Further, the controlling section 200 is in connection to a temperature-humidity sensor 301, as a temperature-humidity sensing means, which is capable of detecting the ambient (or internal) temperature and humidity of the image forming apparatus 1. The controlling section 200 is enabled to obtain the temperature and humidity detected by the temperature-humidity sensor 301. Further, the controlling section 200 is in connection to a surface temperature detection sensor 302, as a surface temperature detecting means, which detects the surface temperature of a sheet P of recording medium. Referring to FIG. 1, it is the main assembly of the image forming apparatus 1 that is provided with the temperature-humidity sensor 301 and surface temperature detection sensor 302. In particular, the surface temperature detection sensor 302 is positioned so that it can detect the surface temperature of a sheet P of recording medium immediately before the sheet P enters the secondary transferring section T2. For example, the surface temperature detection sensor 302 is placed on the upstream side of the secondary transferring section T2, in the recording medium conveyance passage 107 for the two-sided printing mode, in terms of the positive rotational direction (preset direction) of the intermediary transfer belt 2, in the main assembly of the image forming apparatus 1, so that it can detect the surface temperature of the sheet P immediately before the sheet P is moved into the secondary transferring section T2 for the secondary transfer. Referring to FIG. 1, it is desired that the surface temperature detection sensor 302 is placed between the secondary transferring section T2 and the pair of registration rollers 104. The controlling section 200 is enabled to obtain the surface temperature of the sheet P detected by the surface temperature detection sensor 302.

<Wax Removal>

As described above, in the past, in a case where the image forming apparatus 1 is continuously operated in the two-sided printing mode, the wax in a transferred toner image on a sheet P of recording medium is transferred from the sheet P onto the secondary transfer outside roller 34, and then, onto the intermediary transfer belt from the secondary transfer outside roller 34 after the sheet P passed through the secondary transferring section T2. The wax which remains adhered to the intermediary transfer belt 2 is scraped away by the cleaning blade 21. However, as the wax is scraped away, some of the wax collects along the cleaning edge 203 of the cleaning blade 21, making it possible for the wax to turn into multiple minute lumps (protrusions), on the intermediary transfer belt 2. As the melted wax cools down, it becomes solidly fixed to the intermediary transfer belt 2. With the presence of solidified minute protrusive lumps of solidified wax on the intermediary transfer belt 2, it is possible for the image forming apparatus 1 to output defective images and/or the cleaning edge of the cleaning blade 21 to be chipped away by the minute solid lumps of wax on the intermediary transfer belt 2.

Figure 6:
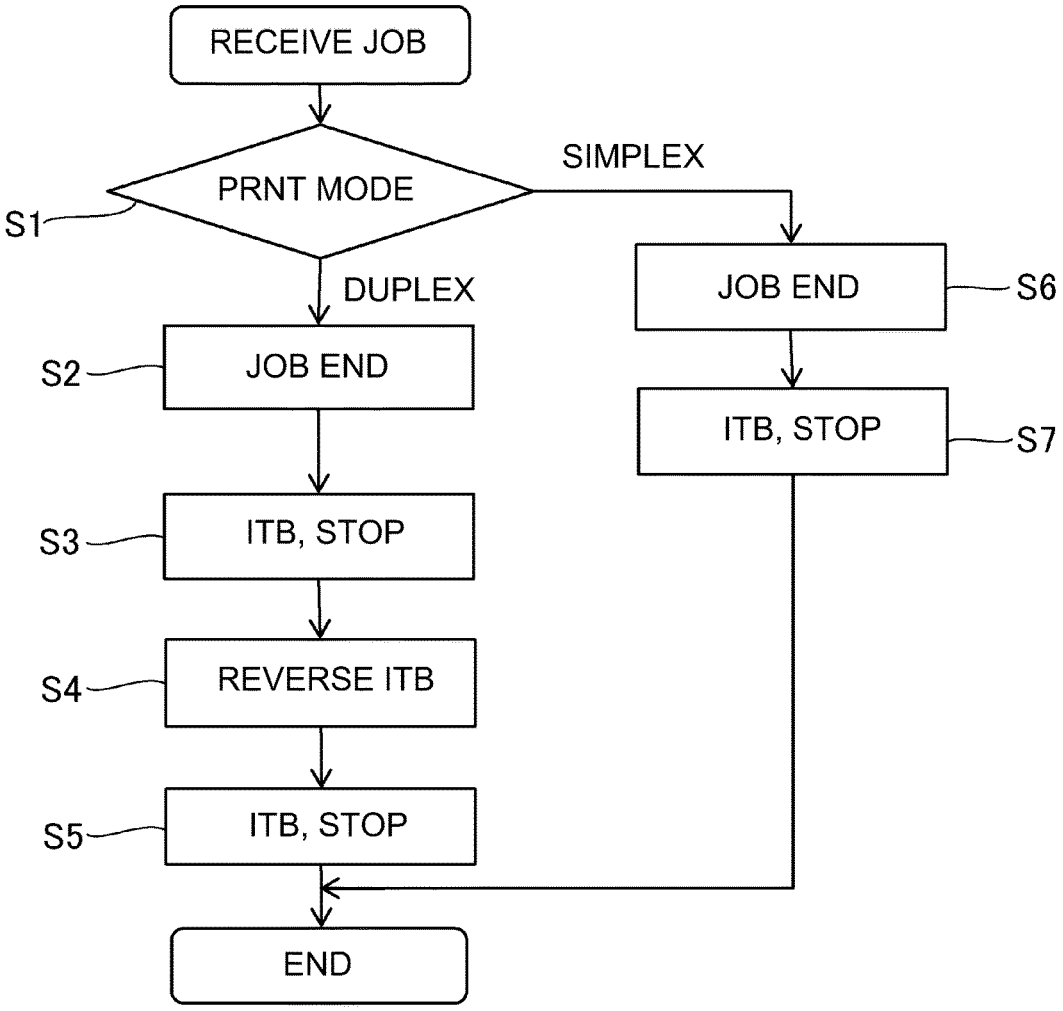
FIG. 6 is a flowchart of the wax removal operation in the first embodiment.

In this embodiment, therefore, in consideration of the above-described issues, it is made possible that as the heated (hot) wax collects along the cleaning edge of the cleaning blade 21, it will be removed before the wax becomes solidly fixed to the intermediary transfer belt 2. Next, referring to FIGS. 6 and 7, the process (mode) for removing the wax from the intermediary transfer belt 2 before the wax becomes solidly fixed to the intermediary transfer belt 2 is described while referring to FIGS. 1 and 3 as necessary. FIG. 6 is a flowchart of the wax removal process. The wax removal process is started by the controlling section 200 at the same time as the image forming apparatus 1 is started in the two-sided printing mode to continuously output a substantial number of prints.

Referring to FIG. 6, as an image forming operation is started, the controlling section 200 decides whether or not the image forming apparatus 1 is in the two-sided printing mode (S1). If it determines that the image forming apparatus 1 is in the one-sided printing mode (one-sided mode in S1), it waits until the completion of the continuous image formation job (S6). As the continuous image formation job is completed, the controlling section 200 stops the intermediary transfer belt 2 which is being rotated in the positive direction (S7). That is, the controlling section 200 controls the intermediary transfer belt driving motor 32M to stop the intermediary transfer belt 2 which is being rotated in the positive direction. Further, the control section 200 stops the rotation of the brush roller 50 by controlling the brush roller driving motor 402. Then, it ends the wax removal process. When the image forming apparatus 1 is operated in the one-sided printing mode, it is unlikely for wax to adhere to the intermediary transfer belt 2. Thus, all that is necessary for the controlling section 200 to do is to stop the rotation of the intermediary transfer belt 2 and that of the brush roller 50 at the completion of the continuous image formation job.

Here, "continuous image formation job" refers to the period from when an image forming operation for continuously forming an image on multiple sheets of recording medium is started in response to a print start signal to when the image forming operation is completed. More concretely, it is the period from when the pre-rotation (preparatory operation for actual image forming operation) is started in response to the print start signal to when the post-rotation (operation to be carried out after completion of actual image forming operation) is started. It includes the actual image forming operation and recording medium intervals. By the way, in case, for example, where the image forming apparatus 1 is instructed to carry out an additional job while it is carrying out a job, two jobs may be considered as one job.

On the other hand, if the controlling section 200 determines that the two-sided printing mode has been selected (two-sided printing mode in S1), the control section 200 waits until the completion of the continuous image formation job (S2). Then, as the job ends, the controlling section 200 stops the rotation of the intermediary transfer belt 2 in the positive direction (S3). That is, the controlling section 200 controls the intermediary transfer belt driving motor 32M to stop the intermediary transfer belt 2 which is being rotated in the positive direction.

Then, the controlling section 200 begins to reversely rotate the intermediary transfer belt 2, by controlling the intermediary transfer belt driving motor 32M, a preset length of time after it stopped the rotation of the intermediary transfer belt 2 in the positive direction (S4). In other words, as soon as the image forming operation in the two-sided mode ends, the controlling section 200 stops the rotation of the intermediary transfer belt 2, and begins to reversely rotate the intermediary transfer belt 2. Then, the controlling section 200 stops the reverse rotation of the intermediary transfer belt 2 by controlling the intermediary transfer belt driving motor 32M, a preset length of time after it started the reverse rotation of the intermediary transfer belt 2 (S5).

Figure 7:
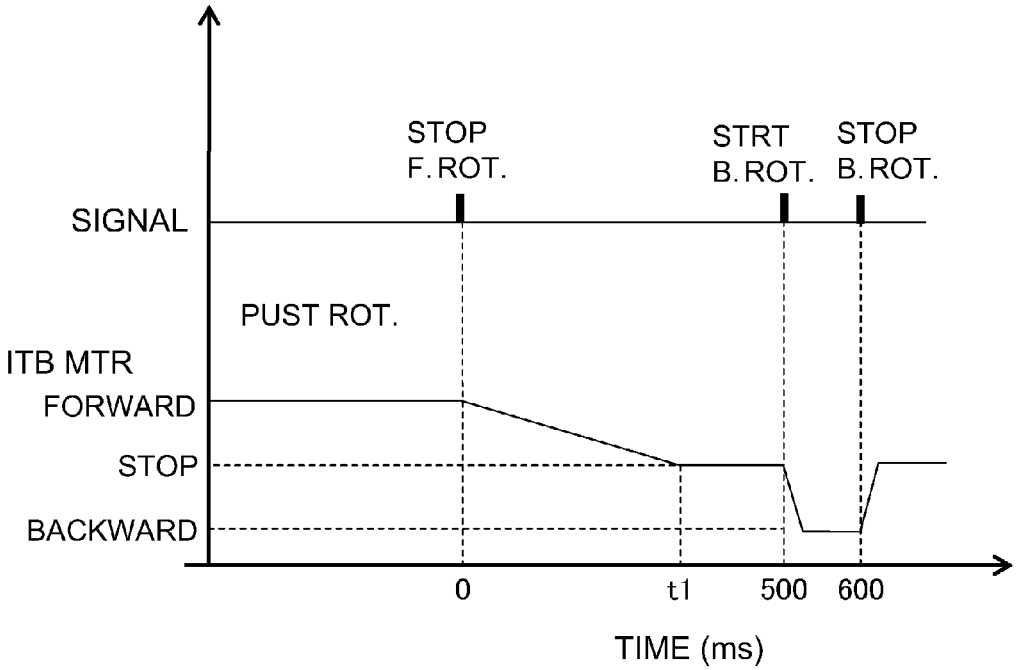
FIG. 7 is a timing chart of the control sequence for controlling the motor for driving the intermediary transfer belt.

Referring to FIG. 7, the controlling section 200 outputs a reverse rotation start signal for starting the reversal rotation of the intermediary transfer belt 2,500 ms, for example, after it outputted the signal for stopping the rotation of the intermediary transfer belt 2 in the positive direction, because it takes a certain length of time (time loss) for the intermediary transfer belt driving motor 32M to actually stop after outputting a signal for rotating the intermediary transfer belt 2 in the positive direction (0-t1 in drawing). During this period, the intermediary transfer belt driving motor 32M continues to rotate due to inertia. Thus, if a signal for reversely rotating the intermediary transfer belt driving motor 32M is outputted while the motor 32M is still rotating in the positive direction due to inertia, it is possible that the intermediary transfer belt driving motor 32M becomes damaged. In order to prevent the occurrence of this problem, the reversal rotation of the intermediary transfer belt 2 is started a preset length of time (500 ms) after the completion of a continuous image forming job. Needless to say, the reversal rotation of the intermediary transfer belt 2 has to be started before the minute lumps of wax having adhered to the intermediary transfer belt 2 become solidly fixed to the intermediary transfer belt 2. As for the preset length of time, 500 ms or so should be long enough for the intermediary transfer belt 2 (intermediary transfer belt driving motor 32M) to come to complete stop, and also, short enough for the wax not to become solidly fixed to the intermediary transfer belt 2.

Also referring to FIG. 7, the controlling section 200 outputs a reverse rotation stop signal for stopping the reverse rotation of the intermediary transfer belt 2, 100 ms, for example, after it outputted the a reverse rotation start signal for starting the reverse rotation of the intermediary transfer belt 2. Referring to FIG. 3, the length of time the intermediary transfer belt 2 is to be reversely rotated has only to be long enough for the portion of the intermediary transfer belt 2, which happens to be in the area M of contact between the intermediary transfer belt 2 and the cleaning edge cover 203 of the cleaning blade 21, passes the area N of contact between the intermediary transfer belt 2 and brush roller 50, at least once. In terms of the reverse rotation direction of the intermediary transfer belt 2, the area M of contact between the intermediary transfer belt 2 and the cleaning edge 203 of the cleaning blade 21 is the most upstream end of the area between the area M of contact between the intermediary transfer belt 2 and the cleaning edge 203 of the cleaning blade 21, and the area N of contact between the intermediary transfer belt 2 and brush roller 50. In other words, it is where wax collects along the cleaning edge 203 of the cleaning blade 21, and turns into multiple minute lumps of wax. As for the area N of contact, it is the area of the outward surface of the intermediary transfer belt 2, which is intersectional with the straight line which connects the rotational axis of the brush roller 50 and the rotational axis of the tension roller 31. In the area N of contact, a part of the wax having collected on the intermediary transfer belt 2 can be effectively removed. As described above, the length of time the intermediary transfer belt 2 is to be reversely rotated has only to be long enough for the intermediary transfer belt 2 to be rotated by at least an amount equal to the distance from the area M of contact to the area N of contact in terms of the reverse rotation direction of the intermediary transfer belt 2. Needless to say, it may be long enough for the portion of the intermediary transfer belt 2, which is in the area M of contact, to pass the area N of contact N two or more times.

As described above, when the image forming apparatus 1 is in the two-sided printing mode, the intermediary transfer belt 2 is reversely rotated long enough for the portion of the intermediary transfer belt 2, which is in the area M of contact between the intermediary transfer belt 2 and the cleaning edge 203 of the cleaning blade 21, to reach the area N of contact between the intermediary transfer belt 2 and brush roller 50, after the completion of a continuous image forming job. In other words, the intermediary transfer belt 2 is rotated in the opposite direction from the direction in which the intermediary transfer belt 2 is rotated while images are actually formed, until the portion of the intermediary transfer belt 2, which happens to be in the area M of contact, reaches the area N of contact at least once.

With the image forming apparatus 1 being controlled as described above, the wax having been scraped away from the intermediary transfer belt 2 and collected along the cleaning edge 203 of the cleaning blade 21 during an image formation period is conveyed to the area N of contact between the intermediary transfer belt 2 and brush roller 50. However, the length of time which elapses during this period is not long enough for the wax having collected along the cleaning edge 203 of the cleaning blade 21 to solidify and become fixed to the intermediary transfer belt 2. Therefore, as the minute lumps of wax having collected along the cleaning edge 203 of the cleaning blade 21 is moved past the area N of contact, it is rubbed by the brush roller 50, whereby it is shaved away at least partially, before the wax becomes solidly fixed to the intermediary transfer belt 2. Thus, even if minute lumps of wax are formed on the intermediary transfer belt 2, they are partially removed by the brush roller 50 as if they are shaved away. That is, the lumps of wax are controlled in height. Therefore, it does not occur during the period in which an image is actually formed, that the image forming apparatus 1 outputs defective images, the defects of which are attributable to the minute lumps of wax on the intermediary transfer belt 2, and/or that the cleaning blade 21 is made to buckle, and/or the cleaning edge 203 is chipped away, by the solidified minute lumps of wax on the intermediary transfer belt 2.

As described above, the wax which builds up along the cleaning edge 203 of the cleaning blade 21 is traceable to the wax in toner; when an unfixed toner image is fixed to a sheet P of recording medium, the wax in toner is melted by the heat applied for fixation, and oozes out of the toner particles. When the ambient temperature of the image forming apparatus 1 is low, it is unlikely for the wax to melt and ooze out of toner particles, and therefore, it is unlikely for wax to adhere to the intermediary transfer belt 2. In this case, therefore, it is unlikely to occur that wax is scraped away from the intermediary transfer belt 2 by the cleaning blade 21, and therefore, it is unlikely to occur that wax lumps up on the intermediary transfer belt 2. Therefore, the inventors of the present invention carried out experiments to determine the temperature level at which the wax in toner particles begins to melt and ooze out of the particles. More concretely, the inventors operated the image forming apparatus 1 in the two-sided printing mode under various conditions which were different in the ambient temperature and humidity. The results of the experiments are shown in FIG. 8, in which a circle means that the wax adhesion did not occur; a black triangle means that the wax adhered, but did not deposit on the intermediary transfer belt 2; and an x means that both the wax adhesion and wax accumulation occurred.

Figure 8:
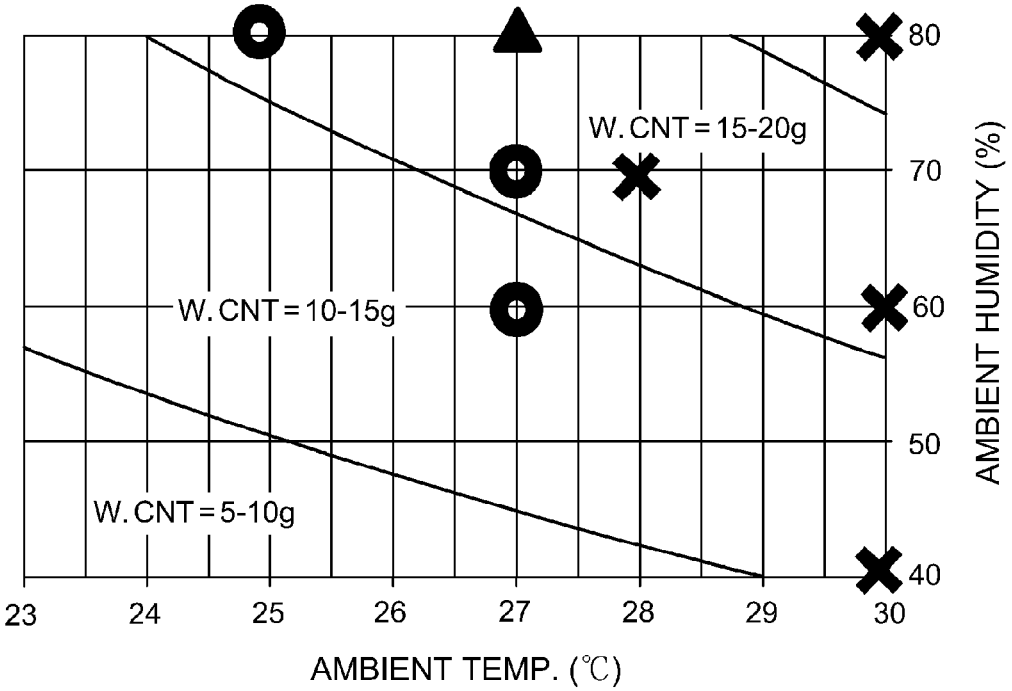
FIG. 8 is a graph which shows the results of experiments which were carried out to find the relationship among the ambient temperature, ambient humidity, and wax adhesion (accumulation), and in which continuous image forming operations are carried out at various ambient temperature levels, and various ambient humidity levels.

Referring to FIG. 8, when the ambient temperature is no more than 27° C., and the ambient humidity is no more than 80%, no wax adhered to, or accumulated on, the intermediary transfer belt 2, for the following reason. That is, when the ambient temperature is low, the surface temperature of a sheet P of recording medium sufficiently reduces by the time an image is formed on the second (back surface) of the sheet P. That is, it is after the temperature of the second (back surface) of the sheet P will have sufficiently reduced that an image is formed on the second surface of the sheet P. Unless the wax having oozed out of toner particles remains soft and sticky (adhesive), it does not occur that the wax on a sheet P of recording medium adheres to the intermediary transfer belt 2 by transferring from the sheet P to the secondary transfer outside roller 34, and then, to the sheet P. However, when the ambient humidity is no less than 80%, it is possible that the wax adhesion to the sheet P will occur due to humidity.

Referring to FIG. 8, when the ambient temperature was no less than 27° C., not only did the wax from toner particles adhere to the intermediary transfer belt 2, but also, accumulated on the intermediary transfer belt 2, for the following reason. That is, when the ambient temperature is high, the surface temperature of a sheet P of recording medium does not sufficiently reduce by the time an image is formed on the second surface of the sheet P. Therefore, while an image is formed on the second surface of the sheet P, the wax having oozed out of toner particles, still remains soft and sticky (adhesive). The soft wax, that is, the wax remaining adhesive, transfers from the sheet P to the intermediary transfer belt 2 by way of the secondary transfer outside roller 34. Once the wax adheres to the intermediary transfer belt 2, it is scraped away by the cleaning blade 21. As the wax is scraped away by the cleaning blade 21, it collects along the cleaning edge 203 of the cleaning blade 21.

<Embodiment 2>

Figure 9:
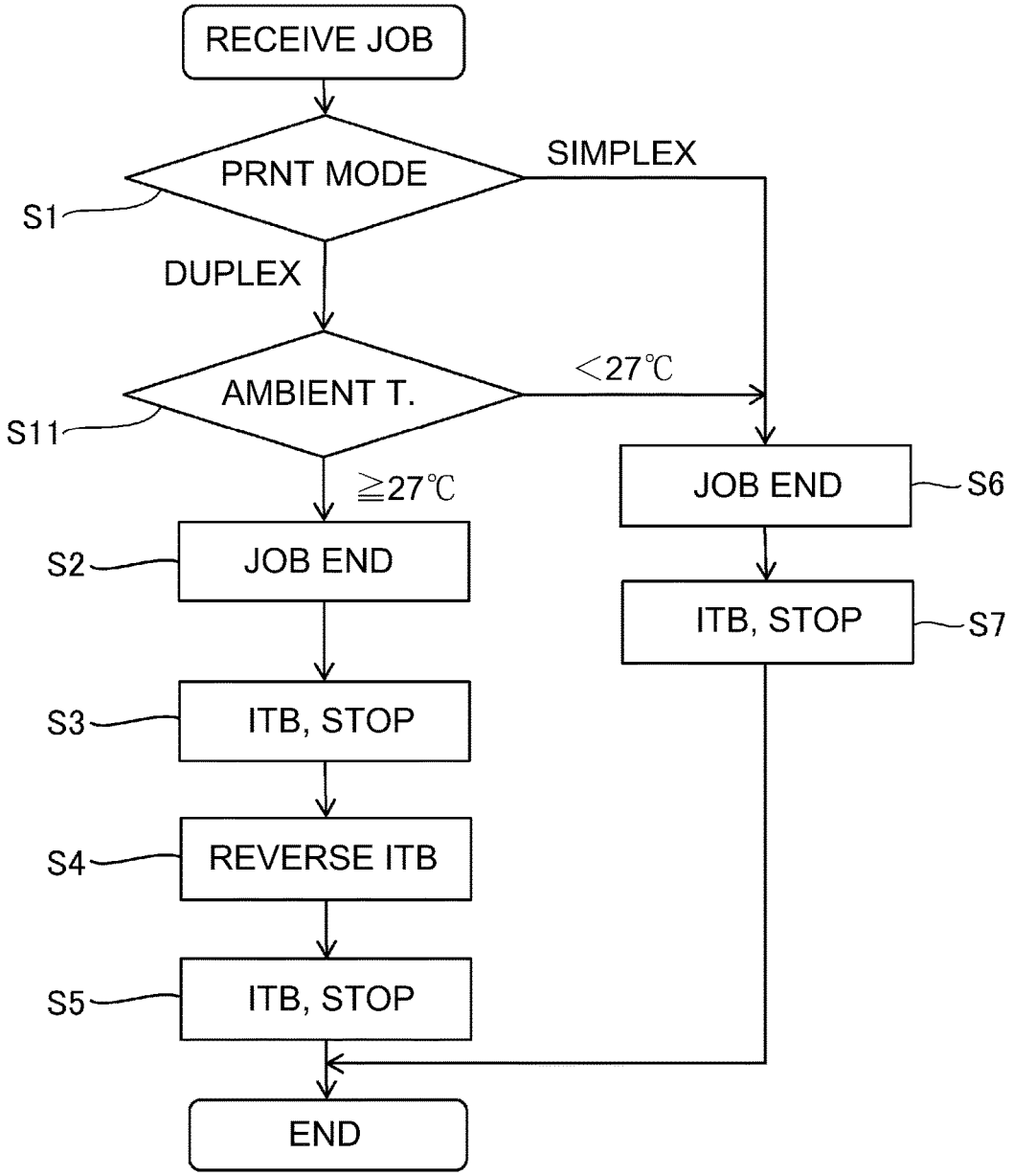
FIG. 9 is a flowchart of the wax removal process in the second embodiment.

In consideration of the results of the above-described experiments, in the case of the wax removal process in the second embodiment, it was made possible for the controlling section 200 to decide whether or not the above-described control (S5) for reversely rotating the intermediary transfer belt 2 should be carried out, based on the ambient temperature of the image forming apparatus 1. FIG. 9 is a flowchart of the wax removal process in the second embodiment. The wax removal process shown in FIG. 9 is similar to the one shown in FIG. 6. That is, the wax removal process is started by the controlling section 200 at the same time as an image formation program is started. In other words, it is started at the same time as an image formation job is started. By the way, the wax removal process shown in FIG. 9 is the same as the wax removal process shown in FIG. 6, except for a step S11. Thus, the steps other than step S11 are not described here.

If the controlling section 200 determines that the image forming apparatus 1 is in the two-sided printing mode (two-sided mode in S1), it obtains the ambient temperature of the image forming apparatus 1 from temperature-humidity sensor 301, and determines whether or not the obtained ambient temperature is no less than a preset level (threshold value, which is 27° C. in this case). If it determines that the ambient temperature is no more than the preset level (no more than 27° C. in S11), it carries out the above-described steps S6 and S7. If it determines that the ambient temperature is no less than the preset level (no less than 27° C. in S11), it carries out the above-described steps S2-S5. That is, when the ambient temperature is no less than the preset level, the wax adhesion and wax accumulation occur. Therefore, in order to shave away the wax having accumulated on the intermediary transfer belt 2 before the wax hardens, the controlling section 200 starts reversely rotating the intermediary transfer belt 2 as soon as the continuous image formation job is completed.

As described above, in the second embodiment, the intermediary transfer belt 2 is reversely rotated only when the ambient temperature is high enough for the wax adhesion and wax accumulation to occur. Therefore, it is possible to obtain effects similar to those obtainable by the first embodiment, and also, the following one. That is, in the second embodiment, it does not occur that when the image forming apparatus 1 is in the two-sided printing mode, the intermediary transfer belt 2 is always reversely rotated immediately after the completion of the continuous image formation job. Thus, the second embodiment can reduce the image forming apparatus 1 in the downtime, compared to the first embodiment. Further, the second embodiment can reduce the amount by which the intermediary transfer belt 2, cleaning blade 21, and brush roller 50 are frictionally worn, and therefore, can extend the replacement cycle for these components, compared to the first embodiment. That is, the second embodiment makes it possible for a user to more efficiently and economically use the image forming apparatus 1 than the first embodiment.

As described above, the wax accumulation which occurs along the cleaning edge 203 of the cleaning blade 21 is attributable to the phenomenon that the wax in toner particles oozes out of toner particles, transfers from the sheet P onto the intermediary transfer belt 2 by way of the secondary transfer outside roller 34, and adheres to the intermediary transfer belt 2. Thus, the inventors of the present invention carried out the following experiments, in order to investigate the surface temperature level of the sheet P, at which wax oozes out of the sheet P. In the experiments, continuous image formation jobs were carried out under various conditions which were different in the ambient temperature of the image forming apparatus 1 and the heating temperature of the fixing device 38. It was confirmed by the results of the experiments that when the surface temperature of the sheet P is no less than 43° C., the wax oozes out of the sheet P, whereas when the surface temperature of the sheet P is no more than 43° C., wax does not ooze out of the sheet P.

<Embodiment 3>

Figure 10:
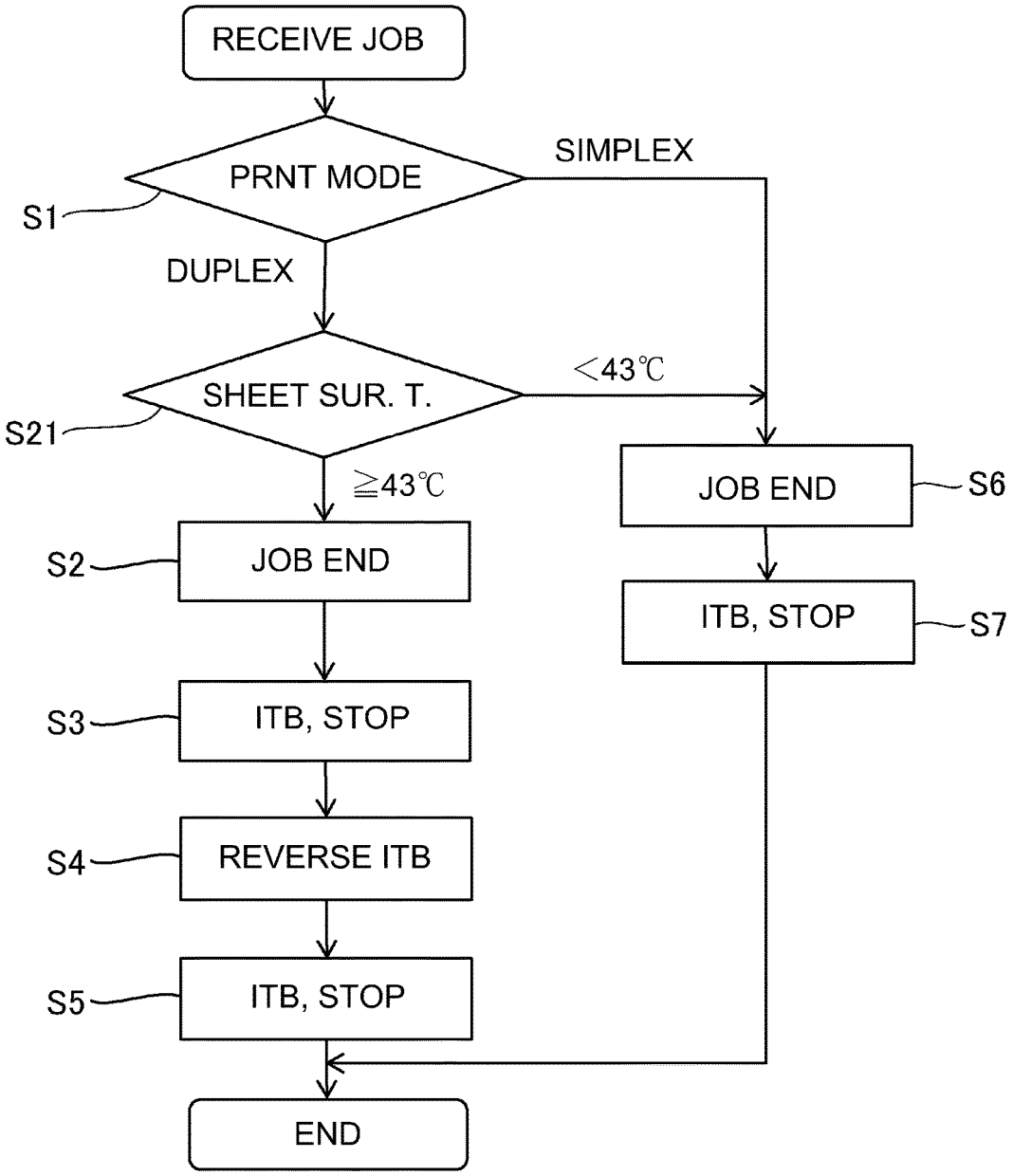
FIG. 10 is a flowchart of the wax removal process in the third embodiment.

In consideration of the results of the above-described experiments related to the second embodiment, whether or not the above-described control for reversely rotating the intermediary transfer belt 2 is to be carried out may be decided based on whether or not the surface temperature of a sheet P of recording medium is higher than the temperature level above which wax oozes out of the sheet P. FIG. 10 is a flowchart of the wax removal process in the third embodiment. The wax removal process in FIG. 10 is similar to the one in FIG. 6. That is, it is started at the same time as an image formation program is started by the controlling section 200. That is, it is started at the same time as an image formation job is started. By the way, the wax removal process shown in FIG. 10 is the same as the one shown in FIG. 6, except for the step S21. Thus, the steps other than the step S21 are not described here.

If the controlling section 200 determines that the image forming apparatus 1 is in the two-sided printing mode (two-sided printing mode in S1), it obtains the surface temperature level of a sheet P of recording medium from the surface temperature detection sensor 302, and determines whether or not the obtained surface temperature level is no less than a preset level (threshold value, which is 48° C. in this embodiment). If the surface temperature is no more than the preset level (no more than 43° C. in S21), the controlling section 200 carries out the above-described steps S6 and S7, whereas if the surface temperature is no less than the preset level (no less than 43° C. in S21), the controlling section 200 carries out the above-described steps S2-S5. That is, when the surface temperature level is no less than the preset level, wax oozes out of the sheet P, and therefore, wax adheres to the intermediary transfer belt 2, and also, accumulates on the intermediary transfer belt 2. Therefore, the reverse rotation of the intermediary transfer belt 2 is started immediately after the completion of the continuous image formation job, in order to shave away the wax having accumulated on the intermediary transfer belt 2, before the wax becomes solidly fixed to the intermediary transfer belt 2.

That is, in this embodiment, the intermediary transfer belt 2 is reversely rotated only when the surface temperature level of a sheet P of recording medium is no less than a level above which wax oozes out of the toner particles, adheres to the intermediary transfer belt 2, and also, accumulates on the intermediary transfer belt 2. The third embodiment also can provide the same effects as those provided by the second embodiment.

<Miscellanies>

By the way, in each of the above-described embodiments, the image forming apparatus 1 was structured to rotationally drive the brush roller 50 so that, in the area of contact between the brush roller 50 and intermediary transfer belt 2, the brush roller 50 rotates in the opposite direction from the positive rotational direction of the intermediary transfer belt 2. However, these embodiments are not intended to limit the present invention in scope in terms of the direction in which the brush roller 50 is to be rotated. For example, the image forming apparatus 1 may be structured so that in the area of contact between the brush roller 50 and intermediary transfer belt 2, the brush roller 50 is rotated by the rotation of the intermediary transfer belt 2, in the same direction as the positive rotational direction of the intermediary transfer belt 2.

However, the brush roller 50 can more efficiently remove the transfer residual toner from the intermediary transfer belt 2 during an image formation period, and also, the wax from the intermediary transfer belt 2 during the wax removal period, when it is rotated in such a direction that, in the area of contact between the brush roller 50 and intermediary transfer belt 2, it rotates in the opposite direction from the positive rotational direction of the intermediary transfer belt 2, than when it rotates in the same direction as the intermediary transfer belt 2. Thus, the image forming apparatus 1 may be structured so that during the wax removal period, the brush roller 50 is rotated in the opposite direction from the direction in which it is rotated during the image formation period. In this case, the controlling section 200 begins to reversely rotate the brush roller 50 by controlling the brush roller driving motor 402 at the same time as it begins to reversely rotate the intermediary transfer belt 2. That is, as soon as the continuous image formation job is completed, the controlling section 200 begins to rotate the intermediary transfer belt 2 and brush roller 50 at preset speeds, respectively, in the opposite directions in which they are rotated during the continuous image formation job. Then, it stops the rotation of the brush roller 50 by controlling the brush roller driving motor 402 at the same time as it stops the reversal rotation of the intermediary transfer belt 2 (S5 in FIG. 6), after the elapse of a preset length of time since the starting of the reversal rotation of the intermediary transfer belt 2.

By the way, the intermediary transfer belt 2 may be rotationally driven so that the portion of the intermediary transfer belt 2, which happens to be in the area M of contact when the rotation of the intermediary transfer belt 2 in the positive direction was stopped, is reciprocally moved twice or more times between the area M of contact and area N of contact. Moreover, the image forming apparatus 1 may be structured so that the controlling section 200 controls the brush roller driving motor 402 so that the brush roller 50 is rotationally driven alternately in the positive and reverse directions.

By the way, in each of the above-described embodiments, the image forming apparatus 1 was structured so that when the image forming apparatus 1 is in the two-sided printing mode, the intermediary transfer belt 2 begins to be reversely rotated at the completion of the continuous image formation job. However, these embodiments are not intended to limit the present invention in scope in terms of when the reversal rotation of the intermediary transfer belt 2 is to be started. For example, the image forming apparatus 1 may be structured so that the intermediary transfer belt 2 is reversely rotated for wax removal, right after the ongoing continuous image formation job, which was being carried out in the two-sided printing mode, was interrupted because of such errors (problems) that the image forming apparatus 1 ran out of replenishment developer, recording medium (sheets P), etc. In such a case, the image forming apparatus 1 may be structured so that the interrupted image formation job in the two-sided printing mode can be restarted after the completion of the wax removal process.

Further, in each of the above-described embodiments, the intermediary transferring component was in the form of a belt (intermediary transfer belt 2). However, these embodiments are not intended to limit the present invention in scope in terms of the choice of intermediary transferring component. For example, the intermediary transferring component may be in the form of a drum.

Also in each of the above-described embodiments, the image forming apparatus 1 was described as a full-color printer. However, these embodiments are not intended to limit the present invention in scope in terms of the choice of image forming apparatus to which the present invention is applicable. That is, the present invention is applicable to any image forming apparatus as long as the apparatus is structured to carry out the secondary transferring process with the use of an intermediary transferring component, regardless of whether the apparatus is of the tandem type or single drum type, and also, regardless of its charging method, image forming method (electrophotographic method or not), developing method, transferring method, and fixing method. Some of the examples of image forming apparatuses to which the present invention is applicable are various printing machines, copying machines, facsimile machines, multifunction image forming machines, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-085442 filed on Apr. 17, 2015, which is hereby incorporated by reference herein in its entirety.

What is claimed is:

1. An image forming apparatus comprising:

an image bearing member configured to bear a toner image;

an intermediary transfer member, which contacts said image bearing member to form a primary transfer portion between said intermediary transfer member and said image bearing member, said intermediary transfer member being rotatable in a predetermined direction and configured to primary-transfer the toner image thereon from said image bearing member in the primary transfer portion during an image forming operation;

a secondary-transfer rotatable member, which contacts said intermediary transfer member to form a secondary transfer portion between said secondary-transfer rotatable member and said intermediary transfer member, configured to secondary-transfer the toner image from said intermediary transfer member onto a recording material in the secondary transfer portion;

a fixing device configured to heat the toner image on the recording material to fix the toner image on the recording material;

a feeding portion configured to reverse a facing orientation of the recording material having passed through said fixing device and to feed the recording material into the secondary transfer portion;

a cleaning blade, which contacts said intermediary transfer member at the position downstream of the secondary transfer portion with respect to the predetermined direction and is configured to clean said intermediary transfer member;

a rubbing rotatable member, provided between the secondary transfer portion and said cleaning blade with respect to the predetermined direction and configured to rub said intermediary transfer member; and an executing portion configured to rotate, after stop of rotation of said intermediary transfer member as a result of completion or interruption of the image forming operation, said intermediary transfer member in a direction opposite to the predetermined direction until a portion of said intermediary transfer member contacted to said cleaning blade moves at least to a position opposing said rubbing rotatable member, wherein said executing portion executes the opposite direction rotation in a double-sided printing mode in which images are formed on both sides of the recording material, and does not execute the opposite direction rotation in a single-sided printing mode in which an image is formed on only one side of the recording material.

2. An image forming apparatus according to claim 1, further comprising a temperature detecting member configured to detect an ambient temperature or a temperature of the recording material after passing through said fixing device, said executing portion executes the opposite direction rotation when a mode of the image forming operation is the double-sided printing mode, and a result of the direction of said temperature detecting member is indicative of a temperature higher than a predetermined temperature.

3. An image forming apparatus according to claim 2, wherein said feeding portion includes a double-sided-printing feeding path along which a reversed recording material is fed towards the secondary transfer portion, and said temperature detecting member is disposed upstream of the secondary transfer portion in the double-sided-printing feeding path with respect to the predetermined direction.

4. An image forming apparatus according to claim 1, further comprising a rotation source configured to rotate said rubbing rotatable member, said rotation source rotating said rubbing rotatable member in such a direction that, at a position where they are contacted to each other, a moving direction of said rubbing rotatable member is opposite to a moving direction of said intermediary transfer member rotating in the predetermined direction.

5. An image forming apparatus according to claim 1, wherein said rubbing rotatable member electrostatically attracts toner remaining on said intermediary transfer member after a secondary-transfer operation during the image forming operation.

* * * * *